US009970678B2

(12) United States Patent
Kapila et al.

(10) Patent No.: US 9,970,678 B2
(45) Date of Patent: May 15, 2018

(54) ENERGY EFFICIENT ELECTRIC HEATER FOR AIR AND OTHER GASEOUS FLUID

(71) Applicants: Nivedita Kapila, Aurora, IL (US); Vempati Venkati Sundereswar Rao, Secunderabad (IN)

(72) Inventors: Nivedita Kapila, Aurora, IL (US); Vempati Venkati Sundereswar Rao, Secunderabad (IN)

( * ) Notice: Subject to any disclaimer, the term of this patent is extended or adjusted under 35 U.S.C. 154(b) by 178 days.

(21) Appl. No.: 14/719,231

(22) Filed: May 21, 2015

(65) Prior Publication Data

US 2016/0273801 A1 Sep. 22, 2016

(30) Foreign Application Priority Data

Mar. 16, 2015 (IN) ..... 1305/CHE/2015

(51) Int. Cl.
*F24H 3/00* (2006.01)

(52) U.S. Cl.
CPC ..... *F24H 3/002* (2013.01)

(58) Field of Classification Search
USPC ..... 219/532, 476, 477, 478, 536, 537, 541, 219/552, 397, 255, 256, 267; 29/428; 338/299, 304, 305, 319, 320
See application file for complete search history.

(56) References Cited

U.S. PATENT DOCUMENTS 3,783,236 A 1/1974 Edin
4,035,613 A * 7/1977 Sagawa ..... H05B 3/18 219/238
4,100,397 A * 7/1978 Kunimi ..... A45D 1/04 132/232
4,621,251 A * 11/1986 Keefe ..... H05B 3/46 219/236
4,629,864 A 12/1986 Wilson
4,713,524 A * 12/1987 Leo ..... F02M 31/125 123/549
4,795,885 A * 1/1989 Driggers ..... B23K 1/18 219/534
4,861,966 A * 8/1989 Matthiesen ..... B01D 35/06 123/549
4,899,032 A * 2/1990 Schwarzl ..... F24H 3/0405 219/505
4,987,290 A 1/1991 Okuno
(Continued)

*Primary Examiner* — Dana Ross
*Assistant Examiner* — Joe E Mills, Jr.
(74) *Attorney, Agent, or Firm* — Law Offices of Steven W. Weinrieb

(57) ABSTRACT

An improved energy efficient electric, heater for air and other gaseous fluid comprise of a) ceramic monolithic heater body 3 provided with plurality of passages 4, inclined from proximal to distal end, making an angle with reference to the longitudinal central axis of the said heater body, and b) one or more electrical resistance heating elements 6, with their terminal ends 10 connected to a common power source. One additional passage 7 can be provided along its longitudinal central axis for insertion of a second fluid transfer pipe 8 for a secondary fluid that is to be mixed, heated and or dried. The heater body 3 is enclosed in metal casing 1, with an insulation layer 9 in between and fastened to an air pipe 15 from an air source 13 at the inlet side and an extension pipe 16 at the outlet end and can be effectively utilized in spray drying, surface heating, shrink wrapping etc.

18 Claims, 5 Drawing Sheets

(56) References Cited

U.S. PATENT DOCUMENTS 5,109,473 A * 4/1992 Rezabek ..... H05B 3/80 219/523
5,134,684 A * 7/1992 Mishou ..... F24H 3/0405 392/379
5,303,325 A * 4/1994 Pasternak ..... F24H 3/0405 219/539
5,427,086 A 6/1995 Brownell
5,641,421 A * 6/1997 Manov ..... F24H 3/002 148/403
5,874,050 A * 2/1999 Matias ..... A61L 9/16 392/465
5,907,663 A * 5/1999 Lee ..... H05B 3/44 219/534
6,054,692 A * 4/2000 Hitomi ..... E01C 11/265 219/469
6,396,033 B1 * 5/2002 Renwick ..... F04B 39/06 219/523
6,593,547 B1 * 7/2003 Raad ..... H02K 15/125 219/201
7,324,746 B2 * 1/2008 Tanaka ..... F24H 1/142 219/541
7,576,306 B2 * 8/2009 Lewin ..... H05B 3/44 219/202
7,592,572 B2 * 9/2009 Schlipf ..... H05B 3/04 174/102 P
7,833,354 B2 * 11/2010 Kim ..... C23C 14/243 118/726
2010/0129157 A1 * 5/2010 Reddy ..... A01M 17/002 405/128.7
2012/0061379 A1 * 3/2012 Vempati Venkata .. F24H 3/0405 219/553
2012/0241439 A1 * 9/2012 Hashimoto ..... F01M 5/00 219/553
2013/0161314 A1 * 6/2013 Emami ..... F27D 11/02 219/397
2013/0175212 A1 * 7/2013 Baba ..... B01D 29/11 210/416.1

* cited by examiner

ENERGY EFFICIENT ELECTRIC HEATER FOR AIR AND OTHER GASEOUS FLUID

FIELD OF INVENTION

This invention relates to an improved energy efficient electric heater for gaseous fluid in general and a hot air generator in particular. Owing to the unique design of the heater body unlike those available in the regular hot air generator/blower, the hot air leaving the heater is made to travel along a longer, divergent conical path, thereby providing uniform heat to the hot air emerging out of the generator/blower at any given instant covering comparatively larger radial area. In addition, during the process of heating of gaseous fluids or plurality of individual gaseous fluids, the severe turbulence created within the path, results in better mixing of its constituent components or even with other fluids which is to be mixed or dried. The uniqueness of this heater also makes it very useful in applications like spray drying, hot gas mixing, chamber heating, surface drying, aseptic shrink wrapping etc.

BACKGROUND OF THE INVENTION

Numerous models of heaters for hot air blowers, hot air generators and heaters to heat gases are available according to prior art. However none of these heaters are designed to generate a self-induced divergent flow path to the gas or air after emerging out of the heater.

Reference is made to U.S. Pat. No. 5,303,325, U.S. Pat. No. 5,134,684, U.S. Pat. No. 3,783,236, U.S. Pat. No. 4,987,290, U.S. Pat. No. 5,427,086 and U.S. Pat. No. 4,629,864. Though the prior art devices discloses many designs of air heaters and hot air blowers, none of these devices incorporate any provision to achieve a diverging flow of hot fluid at the outlet of the heater or to alter the hot air flow path after emerging out of the heater without any additional means to create turbulence.

Hence a need is felt to develop a state of the art device for heating air or any other mixture of gaseous fluids individually fed or premixed. The present invention has been developed addressing drawbacks of the prior art devices and the currently available heaters in the market, and also taking into consideration of futuristic requirements. Accordingly, the present invention has been developed to provide an improved and versatile hot air generator that has multiple advantages over the prior art technology available including the disclosure made in patents/patent applications and other published literature. Similar to air, other gaseous fluid also can be heated or mixed or dried.

Summing up, the prior art disclosures suffer from the following often observed limitations 1) None of the above mentioned devices have the capacity to throw air in a radially diverging path.

2) None of the above devices can generate a turbulence that is beneficial in mixing and spreading operations of gases.

3) None of the prior arts can improve the performance of a drying operation in processes like spray drying on their own, and hence the prior art necessitated that the hot air is injected in a tangential manner to create turbulence or obstructions are created in the air path to create turbulence.

4) The prior arts did not provide any means to minimize heating element sag during hot stage resulting in reduced life of the heater. In fact an additional physical structure had to be provided to prevent the heating element sag.

5) In the prior art devices, the length of heating element is limited to overall length of the container in which the heater element is located and its own coil diameter.

To overcome the above deficiencies, an electrically operated hot air generator of improved design which ensures maximum energy efficiency, ensures divergence of hot air at the exit, increased turbulence when allowed to exit into narrow restricted spaces, increased heating element length for longer life, improved element support to minimize element sag during the heating process, simplicity in construction and easiness in control on the heating parameters, and the ability to contribute to the improved performance of different application such as spray drying, shrink wrapping etc.

Increased interest in spray drying of powders and particularly nano-powders by spray Pyrolysis etc., necessitates the development of a proper device to achieve the end results in a more economic and efficient manner. The electrical heater of the present invention offers a simplified solution by which the device can also function as a regular hot air blower to heat spaces and objects where ever required as well as to heat gases and other fluids like steam to increase their temperature.

The heater leaves behind a very small carbon foot print due to its unique design. Further additional accessories to create turbulence can also be avoided. End result is savings in time required for heating, achieving uniformity in heating and mixing, increased energy efficiency, and reduced power requirements.

Therefore the main objective of the present invention is to provide an energy efficient and versatile electrical heater which can be employed in a hot air blower or heat generator.

Yet another object of the present invention is to have a hot air blower with less number of moving parts, compact in size, prolonged heating element life and easiness in assembly and disassembly and reduced operating and maintenance costs.

One more object of the invention is to have a hot air blower which can produce diverging hot air at the exit with uniformity in heat and can also result in proper mixing when more than one fluid is used.

Yet another objective of the present invention is to offer increased support to the heating element to prevent its sagging by inclining the passage or the channel, so that the element can partly rest on the adjoining walls while the element is hot.

Yet another objective is to provide longer channel space within the available body length by inclining the individual passages or the channels preferably of tubular cross section.

Another objective of the present invention is to have a hot air blower which can have universal application The above mentioned objectives have been achieved by our invention where state of the art technologies are employed in designing and manufacturing the ceramic heater body. Accordingly we have come out with a ceramic heater body with all the passages or channels inclined with reference to the central axis of the heater body, but not parallel to each other, thus allowing the emerging air flow in a divergent manner at the out let with reference to the inlet air entry and away from individual passage/channel outlets causing a diverging hot air stream.

BRIEF SUMMARY OF THE INVENTION

According to the present invention, the improved and energy efficient electric heater for air and other gaseous fluids comprises of a metallic casing forming the main body, holding a ceramic heater body in place rigidly and the main body has means to support itself and other components in any enclosure or to any equipment part. The ceramic heater body is provided with plurality of channels or passages with square or circular or elliptical cross section, starting one end of the ceramic body to the other end. It is not essential that these channels or passages are parallel to one another, but have to be inclined from proximal end to distal end making an angle with reference to the longitudinal axis of the ceramic body and independently open to air or gaseous fluid that is allowed to enter and exit through them. One or more electrical resistance heating elements in the form of a coil or in any other known geometric form is disposed in said channels or passages of said heater body with the two common ends terminated at terminal ends and the terminal ends are connected to a common power source and the total body is properly grounded Accordingly when the electrical heating element is energized, and air or gas is allowed to pass through one end of the channels or passages, due to convection of heat, the air flowing through the passages gets heated up during its travel and exits from the other end. Since the channels or passages are all inclined to one another as explained earlier, the hot air exits from the other end of all the channels in a diverging path and spreads out as it moves away from the heater exit port.

According to one aspect of the invention while the heater body will have all the channels inclined to one another, the central portion of the heater body will have one more passage along its longitudinal central axis and this passage will perform as a means for insertion of a thermocouple or a second fluid transfer pipe. The second fluid transfer pipe can supply yet another fluid which is required to be mixed with the fluid passing through the rest of the peripheral channels in addition to heating as well as drying.

According to yet another aspect of the invention, a square channel ceramic honeycomb with all the channels inclined to one another made of any known ceramic material can also be used as heater body.

According to one more aspect of the invention, individual cylindrical ceramic tubes with round or square or elliptical cross section is rigidly held between two end plates having symmetric holes matching with the said ceramic tubes inlet and out and is disposed in such a way that tubes are all positioned in an inclined manner to the central axis of the assembly longitudinally, while single or multiple heating element in the form of wire or rod or coil passes through these channels/tubes maintaining continuity of the electrical path and end terminals connected to electric power terminal. The terminal of the each of the heating elements can also be joined through a common terminal at each end, if multiple heating elements are used for each tube.

According to another aspect of the invention, the improved heater is a ceramic monolith body with helically or spirally formed channels or passages in which electrical resistance heating element is disposed of, while through and through tubular passage provided at the longitudinal central axis of the ceramic monolith allows insertion of a second fluid transfer pipe. Here also the second fluid can be mixed, heated and or dried along with the hot fluid passing through the inclined channels.

The heater body can be enclosed in metal casing, with an insulation layer in between and fastened to an air pipe from an air source at the inlet side and an extension pipe at the outlet end which causes restriction at the outlet air path, resulting in generation of severe turbulence and improved homogeneity. Hence it can be effectively utilized in spray drying, surface heating, shrink wrapping etc.

Besides the above mentioned aspects of the invention, possibility exists for various modified configurations involving number of channels or passages, angle of inclination, straightness of the individual channels, heating element dimensions or arrangements etc. In addition scope exists for connecting the heater elements in series or parallel mode, AC power supply, DC power supply etc.

BRIEF DESCRIPTION OF THE DRAWINGS

These and other features, aspects and advantages of the present invention will become apparent to those skilled in the art upon reading the following detailed description of the preferred embodiments, in conjunction with the accompanying drawings, wherein like reference numerals have been used to designate like elements.

Figure 1:
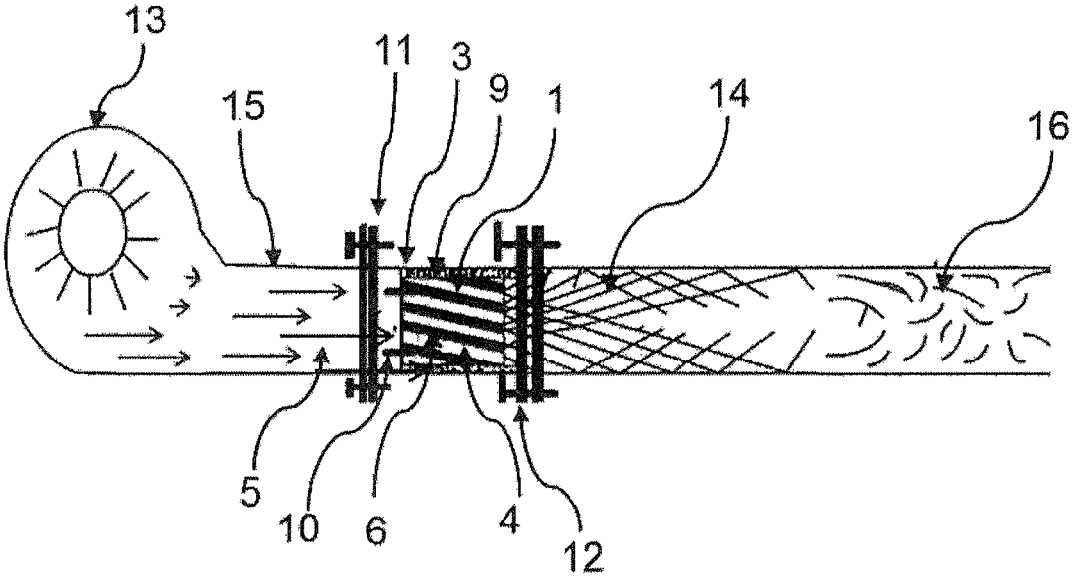
FIG. 1 shows a simplified assembly of the improved electric heater and blower assembly showing the air exiting in a divergent fashion and generating turbulence during its travel, according to an exemplary embodiment under the invention.

Wherein 1. Metal casing; 1*a*, 2*a*,3*a*,4*a*,5*a*,6*a*,7*a*,8*a*,9*a*, 10*a*,11*a*. Proximal end (inlet) of the passage/channel/tube; 1*b*, 2*b*,3*b*,4*b*,5*b*,6*b*, 7*b*,8*b*,9*b*, 10*b*, 11*b*. Distal ends (outlet) of the passage/channel/tube; 3. Heater body; 4. Tubular passage or channel of the heater; 5. Air from air source 13; 6. Electrical resistance heating element; 7 Additional central passage for inserting, tube carrying secondary fluid/thermocouple; 8. Secondary fluid tube with nozzle; 9. Insulation layer between main metallic casing and heater body; 10. Terminal end of the heating element. 11 & 12. Flanges; 13. Air source such as blower; 14. Divergent path; 15. Air pipe; 16. Extension pipe; T1 &T2. Passage for passing the terminal end of the heating element;

DETAILED DESCRIPTION OF THE INVENTION

The present invention discloses an energy efficient and versatile electrical heater which can be employed in a hot air blower or heat generator. This state of the art invention has less number of moving parts, compact in size and has prolonged life for the heating element. Versatility, easiness in assembly and disassembly with reduced operating and maintenance costs are the other specialty of the present invention.

According to the invention an improved energy efficient electric heater for air and other gaseous fluid comprising: a)

ceramic monolithic heater body 3 provided with plurality of channels or passages 4 with square or circular or elliptical cross section, inclined from proximal end to distal end making an angle with reference to the longitudinal axis of the ceramic body open to air or gaseous fluid that is allowed to enter and exit through them and b) one or more electrical resistance heating elements 6 in the form of a coil, or in any other known geometric form disposed in said channels or passages of said heater body with the two common ends terminated at terminal ends 10 which are connected to a common power source and the total body is properly grounded.

In a preferred embodiment under the invention as shown in FIG. 1, the energy efficient and versatile electrical heater for air and gas is having a metal casing 1 provided with internal insulation layer 9 having flanged ends 11&12 encloses a ceramic monolithic body 3 with plurality of channels or passages 4 with square or circular or elliptical cross section, from one end of the ceramic body to the other end and all these passages are nonparallel to one another. All said channels/passages are inclined and making a definite angle to the central axis of the heater body 3. Electrical resistance heating element 6 is provided inside the channels or passages 4 of the heater body 3 in such a way that the heating element 6 passes through each channel or passages 4 once. Both ends of the heating element 6 are terminated at terminal ends 10 and the terminal ends are connected to the power source. An air pipe 15 from an air source 13 is in communion with the inlet side of the metal casing 1 by means of flanges 11. The insulation 9 provided in between the heater body 3 and the metal housing 1 prevents dissipation of heat from the heater by conduction. Heated air exits from the heater body in a divergent path 14 from the outlet end of the passages 4 in the heater body 3. The metal casing 1 is fastened to an extension pipe 16 by means of a flange arrangement 12.

Figure 2:
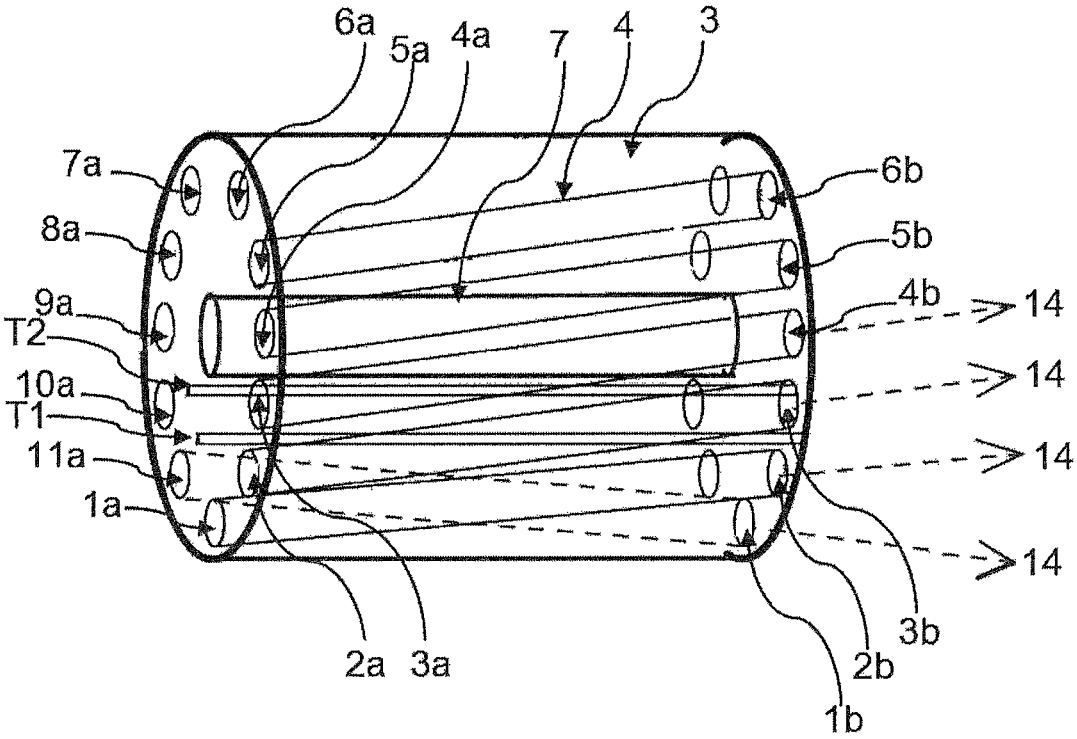
FIG. 2 shows a schematic isometric view of the ceramic monolith heater with passages that are inclined and nonparallel to each other as well as to the central axis of the ceramic monolithic heater body.

For a better understanding of the arrangement of the channels/passages for air or gaseous fluid a schematic isometric view of the ceramic monolith heater with passages that are inclined but non parallel to each other as well as to the central axis of the ceramic monolithic heater body is depicted in FIG. 2. The tubular passages 4 are all positioned in one circular plane but all the passages 4 are inclined to one another and also the central axis. The fluid enters into the ceramic monolith 3 through one end of the passage 4 and exit from its other end. For example the fluid entering at inlet entry point 1*a* of passage exits at point 2*b* and not at 1*b*. All the passages are similarly positioned in a circular plane and are all inclined with reference to the central axis making definite angle and are substantially non parallel to the adjacent passage. However according to one of the embodiment under the invention, means for insertion of a nozzle pipe 8 carrying a second fluid that needs to be heated, mixed and or dried is provided, in the form of an additional passage 7 with its axis parallel to the central axis of the monolith and coinciding with the central axis. Two individual passages T1 and T2 having smaller diameter located at a distance from the central axis are the means for termination of the electrical resistance wire. It facilitates the electric resistance wire travel from one terminal end at T1 and travels through all the passages continually and terminates at terminal end at T2 on the same side.

Figure 3:
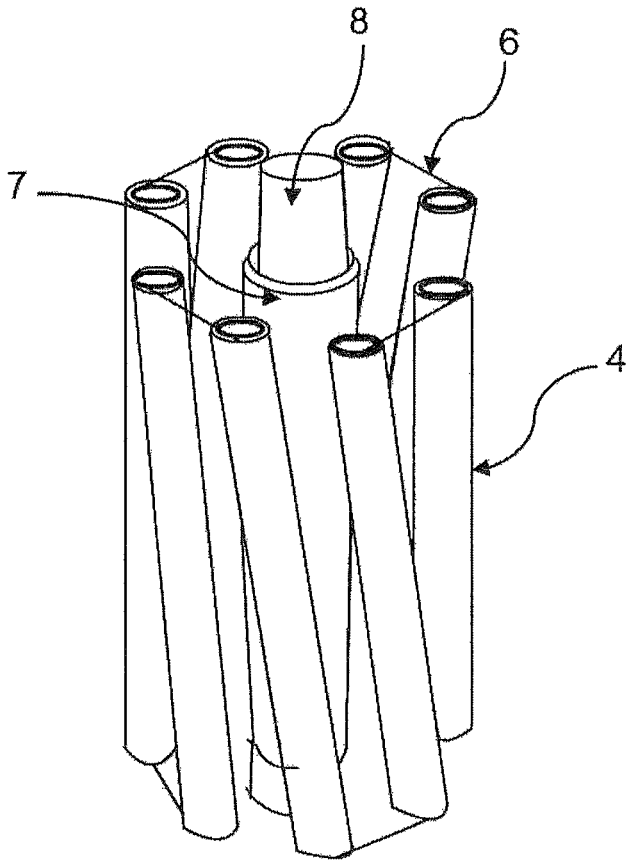
FIG. 3 shows a pictorial isometric schematic view of how one set of the inclined vertical pipe with electrical heating element isolated from the main body when positioned for the purpose of bringing clarity.

In an attempts to show virtually how the passages 4 are inclined to each other, with respect to the central axis of the monolith and how they are positioned in a circular plane, including the travel path of the electric resistance wire, is depicted by way of example in FIG. 3 for clarity. Here electrical resistance heating element 6 in the form of coil or straight strip or wire passes through the passages 4 one after the other and gets terminated at one end. A passage 7 with its axis coinciding with the central axis of the assembly is available for locating a nozzle pipe 8 which performs as a means for flow of a secondary fluid that is to be mixed, heated and or dried.

Figure 4:
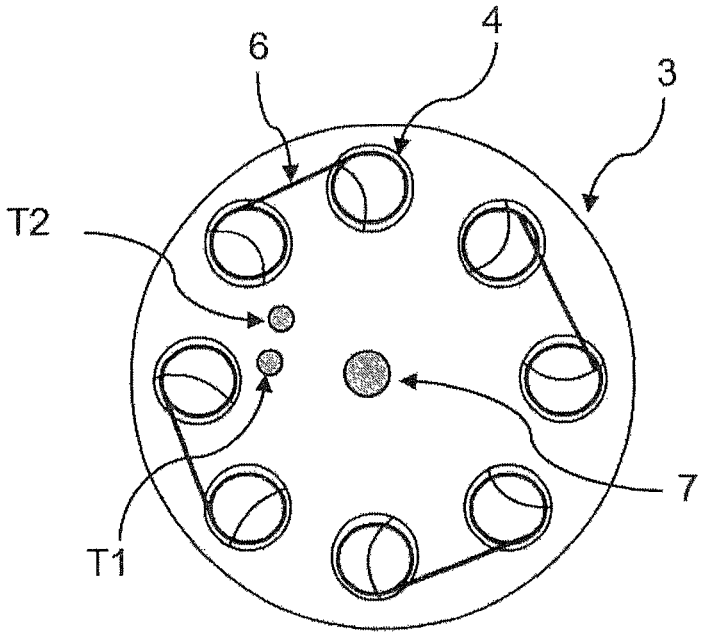
FIG. 4 shows a pictorial end view of one set (8 nos) of the inclined vertical passage, having continuous single electric heating element, in the main ceramic heater body, with a straight central passage and two electric terminal ports for connecting the two ends of the electric heating wire for the purpose of bringing clarity.

FIG. 4 shows top view of the monolith. Here the ceramic monolith 3 with all the inclined passages 4 is provided with the coiled electrical resistance heating element wire 6 within the passages. Said heating element wire passes in and out of the passages 4 before getting terminated at termination ports. The travel path of the electric resistance wire is as follows. To begin with the electrical resistance wire 6 enters at the proximal end of passage T1 and travels through it and ends up at distal end of T1 and then enters through distal end of the adjacent passage and travels towards the proximal end of the same passage and then enters the adjacent passage from the proximal end and so on. Finally the same resistance wire enters from the distal end of the passage T2 and comes to the proximal end and terminates at T2. The central passage 7 is the means for insertion of the nozzle pipe 8 carrying a secondary fluid for heating or drying or mixing.

Figure 5:
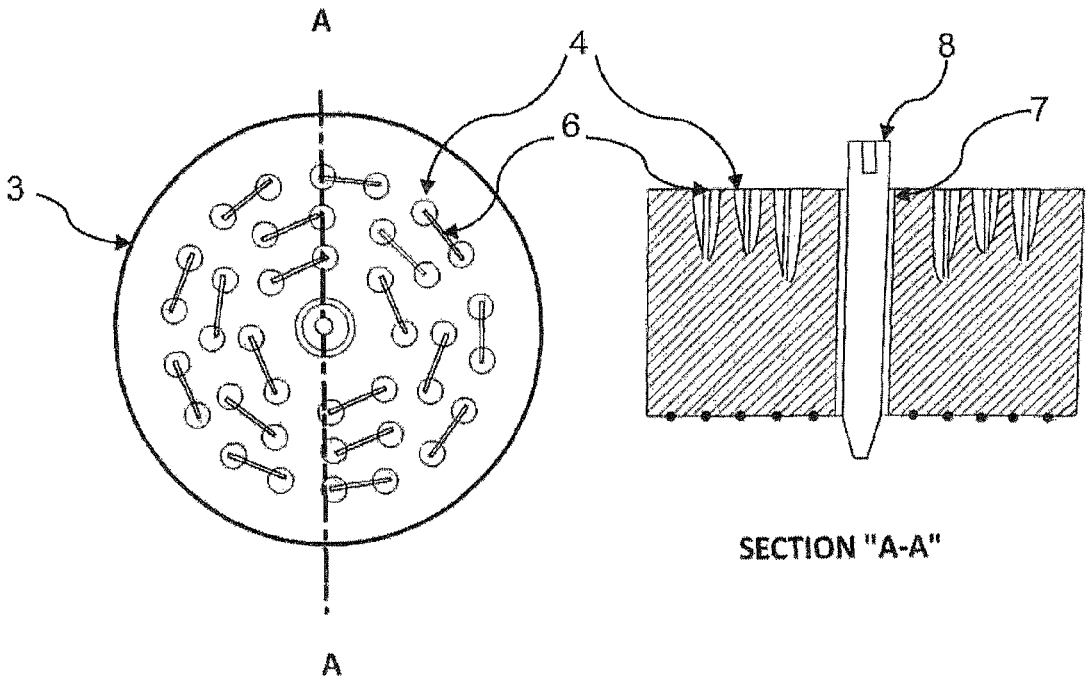
FIG. 5 shows a plan and sectional view of the improved ceramic heater body with inclined channels and resistance heating element wire woven through the channels.

In another preferred embodiment under the invention a ceramic monolith 3 with passages 4 in different sets of circular planes are shown in FIG. 5. It can be seen here that these passages 4 in any one circular plane are necessarily, non-parallel to each other. The passages in any one plane may or may not be parallel to passages in other circular planes. The electrical resistance wire 6 passing in and out of the passages 4 is shown. The central passage 7 along the axis of the ceramic monolith 3 has a nozzle pipe 8 for the secondary fluid to be heated, dried and or mixed. The cross sectional view also shows the inclined passages 4 with the partly visible electrical heating element 6 and the straight central passage 7 and the nozzle pipe 8 for the secondary fluid that needs to be heated, dried or mixed.

When air, gas or any non-conducting and non-combustible gaseous fluid is allowed to pass through one end of all the passages, then it comes in close contact with the heating element during its travel through the passage and the heated air emerges out from the other end of the passages. However owing to the inclined passage configuration, each channel will force the air to exit in a direction that is away from the central axis of the ceramic body as well as away from the adjacent channel. This causes the overall formation of a substantially conical shaped heated air/gas path unlike the straight path hitherto disclosed in the conventional air heater of prior art designs.

Since the tendency of the emerging hot air/gas is to move away from each other, it is in a way spreading out and helping the process of heating the available space faster.

When the air exits the ceramic heater and enters a container or a passageway with in a restricted space or confined by boundary walls, its path is restricted and a severe turbulence is generated. This turbulence allows gas mixtures to mix vigorously yielding to more homogeneity in the product In processes like spray drying, where the liquid spray takes a conical pattern in the chamber, the application of the device under this invention, improves the quality and efficiency of drying. Here the liquid to be spray dried is sprayed through the central passage and the air required for drying is supplied through the surrounding passages 4 and the resultant multi-directional hot turbulent air causes better contact of air and particles resulting in better yield as the spray chamber walls also will be restricting the air flow movement, which enhances the turbulence and improves the efficiency of drying further.

Various advantages according to the present invention can be summarized as under:

The hot air emerging out form the heater is not moving in a straight path and hence it covers a wider area as it moves forward along the longitudinal path. This improves the heat transfer as well as reduces the time to achieve uniformity in any given space.

Resistance to flow outside the exit zone will create a severe turbulence in the air in addition to self-induced resistance as the flow path of the exiting air may clash each other, which can be effectively utilized in applications like spray drying, fluid mixing etc.

The device of the present invention will have wider applications in spray drying, surface heating and shrink wrapping etc.

The Longer overall length available in each channel owing to the inclined or curved path allows more heating element length to be accommodated in it, thereby allowing higher watt densities.

The longer length available also allows the usage of thicker gauge heating element for same watt density thereby increasing heater life.

The inclined shape of the channel offers more wall support to the element as the heating element can now partly rest on the wall at every point, thereby reducing its tendency to sag while it is hot. This improves the heater life.

We have brought out the novel features of the invention by explaining some of the preferred embodiments under the invention, enabling those in the art to understand and visualize our invention. It is also to be understood that the invention is not limited in its application to the details set forth in the above description or as illustrated in the drawings. Although the invention has been described in considerable detail with reference to certain preferred embodiments thereof, various changes and modifications can be made without departing from the spirit and scope of the invention as described herein above and as defined by the appended claims.

We claim:

1. An improved energy efficient electric heater for air and other gaseous fluids, comprising:

a ceramic monolithic heater body having a longitudinal central axis and provided with a plurality of hollow channels or passages, each one of said plurality of hollow channels having a cross-sectional configuration selected from the group comprising a square, a circle, and an ellipse and a diameter, wherein said plurality of hollow channels or passages are all inclined, with respect to said longitudinal central axis of said heater body, from a proximal end of said heater body to an opposite distal end of said heater body, and wherein air or other gaseous fluid is fluidically conducted into said proximal ends of said plurality of hollow channels or passages and is fluidically conducted out from said distal ends of said plurality of channels or passages along divergent loci as a result of said inclined dispositions of said plurality of hollow channels or passages with respect to said longitudinal central axis of said heater body; and one or more electrical resistance heating elements disposed in a geometrical pattern within said hollow channels or passages of said heater body, with terminal end portions of said one or more electrical resistance heating elements being connected to a common power source, so as to heat the air or other gaseous fluid as the air or other gaseous fluid flows through said plurality of hollow channels or passages, whereby as a result of said divergent air or gaseous flows out from said distal end portions of said plurality of hollow channels or passages, a substantially cone-shaped region of heated air or gas is developed so as to heat a larger space than otherwise could be heated if the plurality of hollow channels or passages were not inclined with respect to said longitudinal central axis of said heater body.

2. The improved energy efficient electric heater as claimed in claim 1, wherein:

said plurality of hollow channels or passageways are not parallel to each other.

3. The improved energy efficient electric heater as claimed in claim 1, wherein:

each one of said plurality of hollow channels or passageways is not parallel to an adjacent one of said plurality of channels or passages.

4. The improved energy efficient electric heater as claimed in claim 1, wherein:

two terminal passages, each having a diameter that is smaller than said diameter of each one of said plurality of hollow channels or passages, are disposed at a distance from said longitudinal central axis of said heater body so as to facilitate the disposition of said one or more electrical resistance heating elements to extend continuously from a first terminal end portion, through all of said plurality of hollow channels or passages, and terminate at a second terminal end portion on the same end of said heater body.

5. The improved energy efficient electric heater as claimed in claim 1, wherein:

said first and second terminal ends of said one or more electrical resistance heating elements are joined together at said common power source.

6. The improved energy efficient electric heater as claimed in claim 1, wherein:

said one or more electrical resistance heating elements partly rest upon interior wall portions at multiple locations within said plurality of channels or passages, thereby reducing the tendency of said one or more electrical resistance heating elements to sag when said one or more electrical resistance heating elements gets hot.

7. The improved energy efficient electric heater as claimed in claim 1, wherein:

said inclined disposition of said plurality of hollow channels or passages permits said one or more electrical resistance heating elements, disposed within said plurality of hollow channels or passages, to have a greater length dimension than would ordinarily be able to be achieved if said plurality of hollow channels or passages were oriented parallel to said longitudinal central axis of said heater body, whereby greater watt densities, as well as the use of thicker gauge electrical resistance heating elements for comparable watt density is able to be achieved, thereby increasing the service life of said one or more electrical resistance heating elements.

8. The improved energy efficient electric heater as claimed in claim 1, wherein:

one additional independent channel or passage is provided along said longitudinal central axis of said heater body for accommodating the flow of a secondary fluid that is to be mixed with the air or other gaseous fluid passing through said plurality of channels or passages, heated, or dried.

9. The improved energy efficient electric heater as claimed in claim 1, further comprising:

a pair of end plates fixedly secured to said opposite proximal and distal ends of said heater body for connection to opposite proximal and distal end portions of said plurality of hollow channels or passages defined within said heater body, wherein said pair of end plates each have holes defined therein which symmetrically match said proximal and distal end portions of said plurality of hollow channels or passages defined within said heater body so as to fluidically permit the air or gaseous fluid to enter said plurality of hollow channels or passages at said proximal end of said heater body and to exit from said plurality of hollow channels or passages at said distal end of said heater body.

10. The improved energy efficient electric heater as claimed in claim 1, wherein:

said one or more electrical resistance heating elements comprises a plurality of separate and independent electrical resistance heating elements electrically connected to said common power source.

11. The improved energy efficient electric heater as claimed in claim 1, wherein:

said one or more electrical resistance heating elements comprise heating elements selected from the group comprising a coil, an elongated straight strip, and a straight wire which passes through said plurality of hollow channels or passages defined within said heater body.

12. The improved energy efficient electric heater as claimed in claim 1, wherein:

said one or more heater elements are connected in series or in parallel mode and are operated by means of either an AC power supply or a DC power supply.

13. The improved energy efficient electric heater as claimed in claim 1, wherein:

a metallic casing encompasses said ceramic monolithic heater body wherein said plurality of inclined hollow channels or passages, within which said one or more electrical resistance heating elements are disposed, extend in a substantially helical or spiral manner around said longitudinal central axis of said heater body, and a tubular passage is provided internally within said heater body so as to extend along said longitudinal central axis of said ceramic monolithic heater body whereby said tubular passage permits a second fluid to be mixed with the air or other gaseous fluid passing through said plurality of channels or passages, and heated, or dried.

14. The improved energy efficient electric heater as claimed in claim 1, further comprising:

a metal casing;

an insulation layer interposed between said metal casing and said heater body;

a source of air or other gaseous fluid to be heated;

an air or other gaseous fluid inlet pipe fluidically connecting said source of air to said heater body so as to conduct the air or other gaseous fluid from said source of air or other gaseous fluid into said proximal end of said heater body and into said plurality of channels or passages defined within said heater body;

a first flanged structure fixedly securing said air or other gaseous fluid inlet pipe to said heater body;

an air or other gaseous fluid outlet pipe fluidically connected to said distal end of said heater body so as to conduct heated air or other gaseous fluid out from said plurality of channels or passages defined within said heater body; and a second flanged structure fixedly securing said air or other gaseous fluid outlet pipe to said heater body.

15. The improved energy efficient electric heater as claimed in claim 1, wherein:

said air or other gaseous fluid outlet pipe operatively confines said divergent flow of air or other gaseous fluid issuing from said distal ends of said plurality of channels or passages resulting in the development of turbulent conditions which improves heat transfer and uniformity or homogeneity of the air or other gaseous fluid issuing from said distal ends of said plurality of channels or passages.

16. The improved energy efficient electric heater as claimed in claim 1, wherein:

said electric heater is adaptable for use in connection with spray drying, surface heating, and shrink wrapping.

17. The improved energy efficient electric heater as claimed in claim 1, wherein:

one additional independent channel or passage is provided along said longitudinal central axis of said heater body for accommodating a thermocouple for measuring the temperature of said single electrical resistance heating element.

18. The improved energy efficient electric heater as claimed in claim 1, wherein:

said one or more electrical resistance heating elements comprises a single electrical resistance heating element.

* * * * *